US005654941A

United States Patent [19]

Joss

[11] Patent Number: 5,654,941

[45] Date of Patent: Aug. 5, 1997

[54] DEVICE FOR FASTENING A ROTATIONALLY SYMMETRICAL PART, IN PARTICULAR A ROTATABLE RING, A BACK COVER OR A WATCH-GLASS TO A WATCHCASE

[75] Inventor: Alfred Joss, Romont, Switzerland

[73] Assignee: Walca SA, Bienne, Switzerland

[21] Appl. No.: 647,802

[22] Filed: May 15, 1996

[30] Foreign Application Priority Data

May 26, 1995 [CH] Switzerland ..... 1569/95

[51] Int. Cl.[6] ..... G04B 37/00

[52] U.S. Cl. ..... 368/295

[58] Field of Search ..... 368/276, 294–296

[56] References Cited

U.S. PATENT DOCUMENTS

| | | | |
|---|---|---|---|
| 4,815,053 | 3/1989 | Dal Busco | 368/294 |
| 5,122,997 | 6/1992 | Schneider et al. | 368/294 |
| 5,541,895 | 7/1996 | Nussbaum | 368/295 |

FOREIGN PATENT DOCUMENTS

| | | |
|---|---|---|
| 0 216 420 A1 | 4/1987 | European Pat. Off. . |
| 0 403 717 A1 | 12/1990 | European Pat. Off. . |
| 0 436 468 A1 | 7/1991 | European Pat. Off. . |
| 934190 | 5/1948 | France . |
| 671 670 G A3 | 9/1989 | Switzerland . |
| 684 919 G A3 | 2/1995 | Switzerland . |

*Primary Examiner*—Vit W. Miska
*Attorney, Agent, or Firm*—Oliff & Berridge

[57] ABSTRACT

A rotatable ring is fastened to a watchcase to an encircling, rotationally symmetrical shoulder extending in axial direction with respect to the watchcase. For this purpose an encircling groove is provided on the shoulder along an outer generated surface, from which at least two slots extend which are disposed distributed over the circumference of the groove essentially in axial direction to a face protruding toward the watchcase. Disposed on the rotatable ring are radially directed peg-shaped projections corresponding to the number of slots. To fasten the rotatable ring, the projections are inserted into the groove through the slots, which are preferably inclined with respect to a longitudinal axis of the watch. The projections can then slide along the groove. First and second engagement means, in the example embodiment shown a sawtooth-shaped toothing and a leaf spring with bent up flexible tongues, have the effect that the rotatable ring can be rotated only in one direction, that direction corresponding to the inclined position of the slots. To detach the rotatable ring, the rotatable ring is turned in the blocked direction with increased force.

13 Claims, 6 Drawing Sheets

DEVICE FOR FASTENING A ROTATIONALLY SYMMETRICAL PART, IN PARTICULAR A ROTATABLE RING, A BACK COVER OR A WATCH-GLASS TO A WATCHCASE

This invention relates to a device for fastening a rotationally symmetrical part, in particular a rotatable ring, a back cover or a watch-glass (watch crystal) to a watchcase.

In the watchmaking industry, back covers or watch-glasses are usually pressed onto the watchcase by means of grooved or notched mountings. Also known, especially for waterproof watches are threaded joints between the watchcase and the back cover as well as between the watchcase and the watch-glass. Rotatable rings, which are used especially for divers' watches, can likewise be pressed onto the watchcase with a grooved mounting. However, other types of closures are known here, too, such as tension rings or polygonal spring wires, the last two of which run in grooves disposed on the interior and not visible from outside. Closures of the above-mentioned type are disclosed, for example, in the published European patent applications EP 0 216 420, EP 0 403 717 and EP 0436 468.

Tools are needed to open the above-mentioned closures in all embodiments. The use of a tool entails the risk that in opening or removing, respectively, a mounted part of the watch, such as a rotatable ring, a back cover and/or a watch-glass, damage is done to one of these said parts or scratches are made thereon, It is then necessary to replace the damaged or scratched part. This drawback can be seen very distinctly with watches with rotatable rings, which are fastened to the watchcase in one of the known, above-mentioned ways. It is barely possible to remove the rotatable ring from the watchcase without damaging thereby the ring or the case itself. Expensive repairs are the consequence.

So that rotatable rings in the mounted state can be turned, play must be provided for between the watchcase, to which they will be fastened, and the rotatable ring itself, With the known types of fastening, there is a relatively large amount of play, which not only makes for an unaesthetic appearance, but also encourages the penetration of dirt into any crevice existing between the watchcase and the rotatable ring.

It is the object of the present invention to propose a type of fastening for rotatable rings, back covers and/or watch-glasses on watchcases which eliminates the aforementioned drawbacks.

According to the invention, this object is attained with a device for fastening a rotationally symmetrical part, in particular a rotatable ring, a back cover or a watch-glass to a watchcase.

With the device according to the invention, in introducing the projections of the part to be fastened, such as those of the rotatable ring, of the back cover and/or of the watch-glass, into the grooves disposed on the watchcase, the fastening can take place precisely in the axial direction. A slanted or respectively tilted pressing on is not possible. The mechanical dimensions of the parts adapted to each other—watchcase to back cover, watchcase to watch-glass or watchcase to rotatable ring—can be very finely harmonized. It is thereby possible to make minimal the undesirable crevice existing in the usual designs between the watchcase and the rotatable ring to be mounted thereon. Penetration of dirt at this location is thus prevented.

The mounting and removal of the said parts can be done by hand without the aid of a tool. Thus, especially during removal, no damage occurs to the part involved or to other parts of the watch. Also none of the said parts is deformed owing to any application of force.

It is primarily claimed that the shoulder with the groove and the notches is mounted on the watchcase, and the projections, intended for introduction into the notches or respectively the groove, are provided on the part to be fastened. Nevertheless equally effective designs with interchanging of the parts are likewise possible and are included in the invention. The shoulder can just as well be disposed on one of the parts to be fastened, and the projections can be correspondingly disposed on the watchcase. It is also conceivable that, for example, for fastening a rotatable ring, the shoulder with the groove and the notches is disposed on the watchcase and the projections are disposed on the rotatable ring, while for fastening the back cover, the shoulder with the groove and the notches is disposed on the back cover and the correspond-ing projections on the case. Any conceivable combination and variation, not explicitly mentioned here, of the arrangement of groove with notches and the projections is also possible and is included in the invention.

A precise positioning for introducing the part to be fastened is achieved through the irregular, angled distribution of notches and projections over the circumference.

The notches, which lead into the groove, can extend in precisely axial direction. They can also be inclined in the peripheral direction, however.

If, engagement means are disposed between the rotatable ring and the case in such a way that the rotatable ring can be turned only in one direction, which can be achieved, for example, with a sawtooth-shaped toothing and at least one flexible tongue engaging therein, it is advantageous to dispose one flexible tongue each in the area of each notch, the flexible tongues, with respect to the groove, being directed in an inclined direction opposite the course of the notches. It can thereby be achieved that the projections or the notches of the rotatable ring, which have been introduced into the groove through the notches having an inclined course, can no longer slide by themselves out of the groove through the notches. The dismounting of the rotatable ring takes place in this case by overcoming the force which the flexible tongue sets against the toothing. The flexible tongues can be damaged thereby. It is easily possible, however, and also not expensive, to replace the engagement means with the flexible tongues before re-fastening the rotatable ring.

Instead of flexible tongues, preferably bent from a leaf spring, other spring-impinged elements can be provided. These can be balls, which under the pressure of a spring, either protrude from a case surface or from a surface of the part to be fastened and which engage in a depression of the counterpiece. Using this known device a rotational movement can also be impeded or even prevented.

The surfaces, in each case on the watchcase and on the part or parts, respectively, to be fastened, which are opposite each other and on which the engagement means are disposed, can be either faces or generated surfaces.

Between the watchcase and the part to be fastened, for example the back cover or the watch-glass, sealing elements can be provided so that waterproof watches can also be manufactured using the device according to the invention. A sealing element is not necessary for the rotatable ring disposed on the outside of the watchcase since water penetrating between the rotatable ring and the case is not of consequence.

In the following, the invention will be described more closely, using some example embodiments, with reference to the figures, in which.

Figure 1:
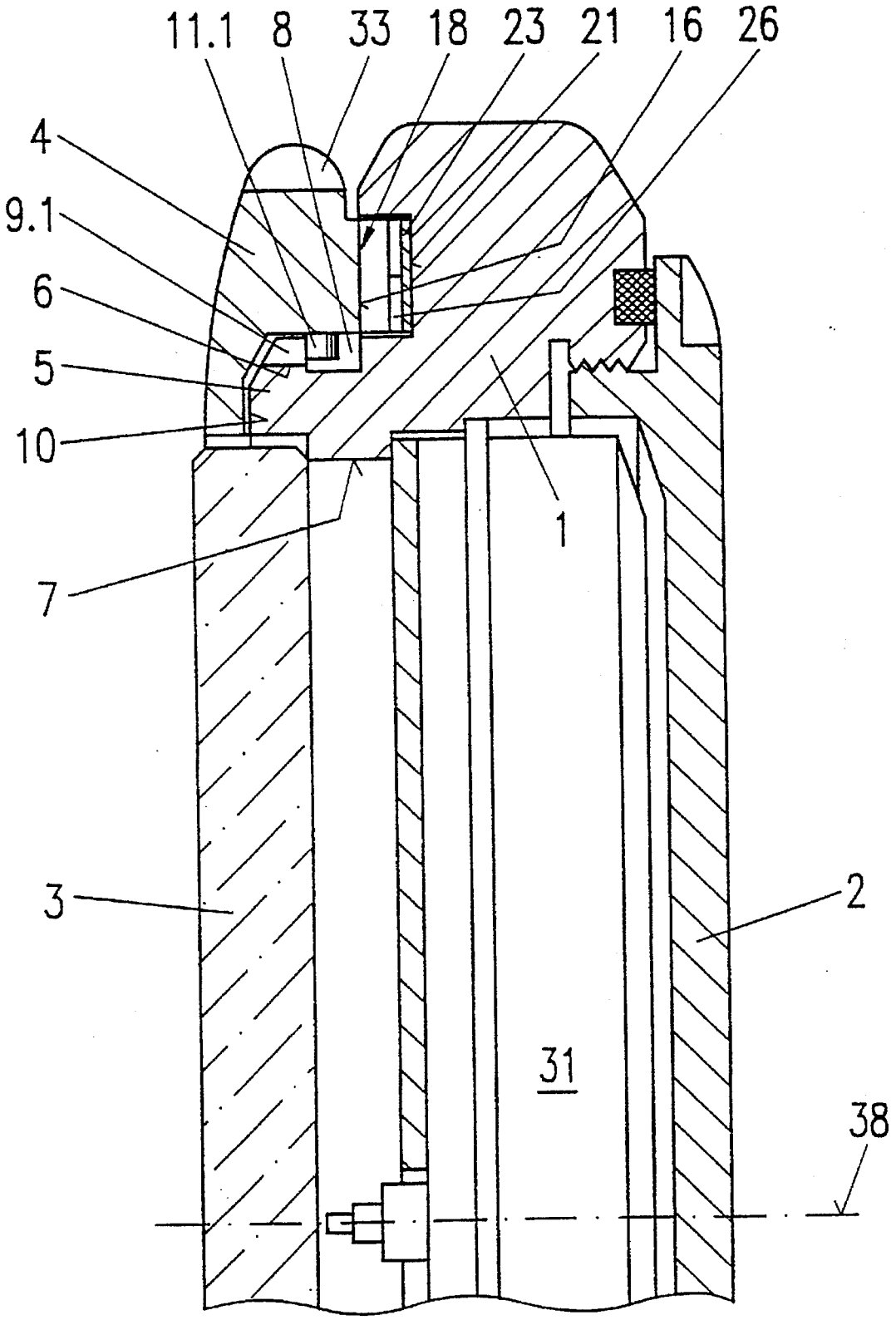
FIG. 1 is a cross-section through a first example embodiment of a wristwatch on which a rotatable ring has been fastened to the watchcase with the inventive device.
Figure 2:
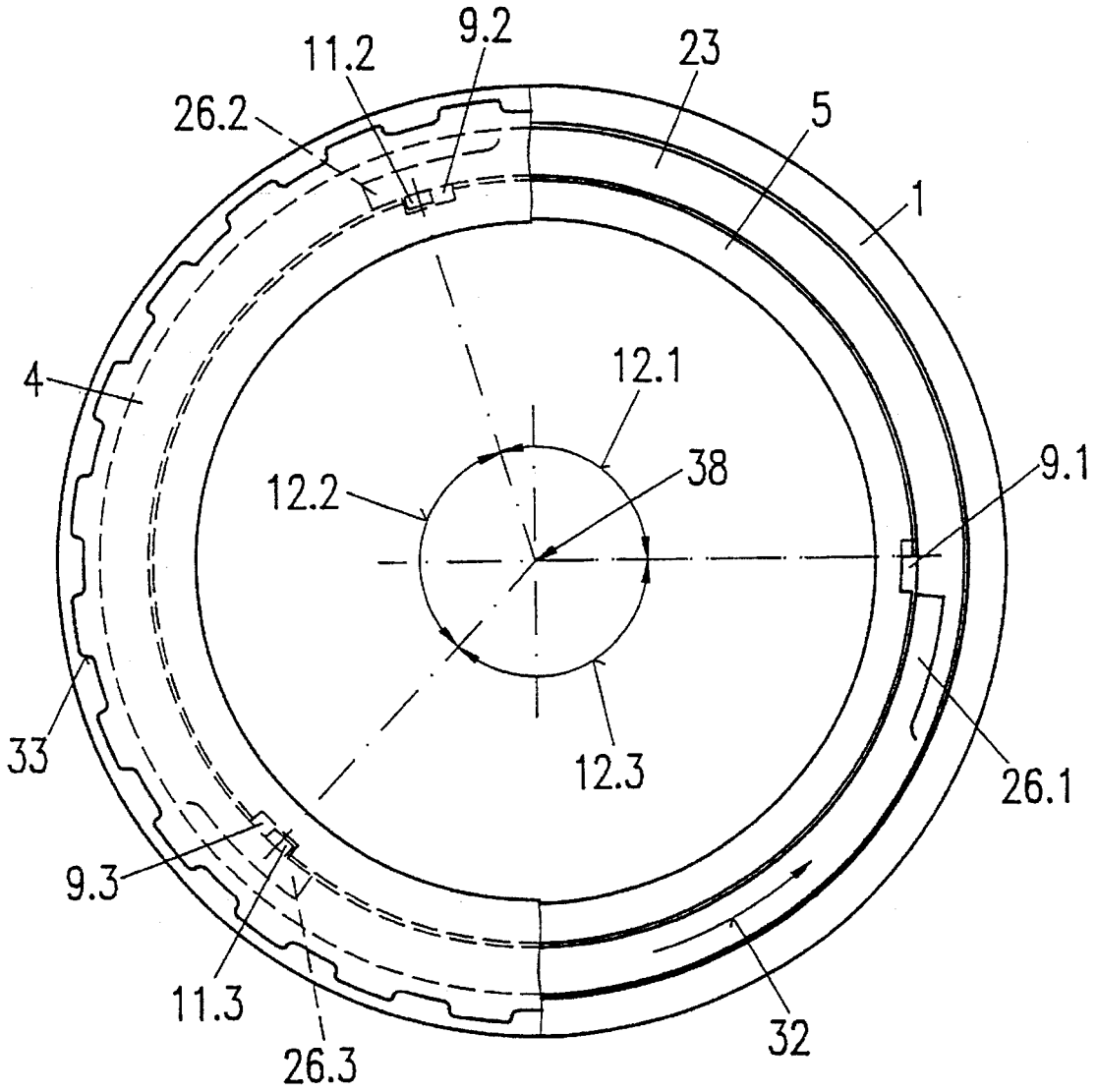
FIG. 2 is a view of the wristwatch of FIG. 1, the rotatable ring being present in the one half of the figure, and absent in the other half.

Shown in FIGS. 1, 2, and 3A to 3C is a first example embodiment of a wristwatch with a rotatable ring fastened with a device according to the invention. It can be seen from the cross-section drawing of FIG. 1 that the wristwatch has essentially a watchcase 1, in particular a caseband 1 in which a movement 31 is mounted in a conventional way. The watchcase 1 is closed off on its underside with a screwed-on back cover 2, and has on its upper side a watch-glass 3, which is likewise fastened in a conventional way.

The watch has furthermore a rotatable ring 4, as is known especially in divers' watches. On the rotatable ring 4, which encompasses the watch-glass 3 on its peripheral circumference, any desired markings can be provided. For fastening the rotatable ring 4, the watchcase 1 has an encircling shoulder 5 extending in axial direction, which shoulder surrounds the generated surface of the watch-glass 3 like a collar in the example embodiment shown. The shoulder 5 has an outer, encircling generated surface 6 and an inner encircling generated surface 7. On the side of the shoulder 5 remote from case 1, the shoulder is limited by a face 10. In the example embodiment shown, an encircling groove 8 has been provided on the outer generated surface 6 of shoulder 5. According to FIG. 2, three notches 9.1, 9.2, 9.3, extend from this groove in axial direction with respect to the aforementioned face 10. The rotatable ring 4 has peg-shaped projections 11.1, 11.2, 11.3 directed radially inward. Concerning their distribution on the circumference of an inner generated surface of the rotatable ring 4, these projections, with respect to each other, have the same angular situation as the notches on the outer generated surface 6 of watchcase 1. Likewise the number of projections corresponds to the number of notches. At least two notches and at least two projections are necessary for fastening the rotatable ring.

The notches 9.1, 9.2, 9.3 can extend parallel to the longitudinal axis 38 of the watch, or respectively perpendicular to the encircling groove 8. This is indicated by the dot-dash line in FIG. 3C.

Notches 9.1, 9.2, 9.3 are made preferably in a slanted direction to groove 8. This can be seen in FIG. 3C, and is indicated by the dash-dot line having the reference numeral 44. The smaller angle 15 formed between the notch direction and the groove is 45° in a preferred embodiment.

So that the rotatable ring 4 can be put on only in a single angular position with respect to the longitudinal axis 38 of the watch, the peg-shaped projections 11.1, 11.2, 11.3, which are directed from the rotatable ring in radial direction to the longitudinal axis of the watch, and the notches 9.1, 9.2, 9.3 in the protruding shoulder 5 of the case are distributed unevenly with respect to the watch circumference. Unequal angles 12.1, 12.2, 12.3 are present between each two adjacent projections or notches, respectively, 11.1, 11.2, 9.1, 9.2; 11.2, 11.3, 9.2, 9.3; 11.3, 11.1, 9.3, 9.1. In any case the angular distribution of the projections corresponds to the angular distribution of notches.

To put on the rotatable ring, the projections 11.1, 11.2, 11.3 are placed above the notches 9.1, 9.2, 9.3, open toward the face 10 of the shoulder 5, and are led through the notches into the groove 8. If the notches are disposed inclined, the introduction takes place with a simultaneous slight turning of the rotatable ring in the direction of the notch inclination. The rotatable ring, led by means of the projections 11.1, 11.2, 11.3, sliding into the groove 8, can now be rotated about the longitudinal axis of the watch.

With rotatable rings of this kind usually the rotation can only take place in one direction, preferably counterclockwise. For this purpose the rotatable ring 4, according to a known design, has first engagement means 18 on a surface 16 turned toward the watchcase 1, in this case a lower face. On a surface 21 of the watchcase 1 turned toward the aforementioned surface of the rotatable ring 4 second engagement means 23 are disposed which cooperate with the first engagement means 18. In the example embodiment shown in FIGS. 1 to 3C, the surface 21 is an annular surface on the watchcase 1, which is designed here as a further encircling groove. Inserted therein is an annular leaf spring, along whose circumference flexible tongues are bent up, these tongues facing the first engagement means 18 of the rotatable ring 4. The first engagement means 18 are designed as a toothing. Teeth 25 are distributed in a particular regular distribution over the circumference of lower face 16 of the rotatable ring 4.

With the rotatable ring placed on, the flexible tongues 26, as the spring-impinged elements, engage in the toothing 25. The toothing is of substantially sawtooth shape such that the flexible tongues 26 bent out of the leaf spring 23 are contiguous to the flank of the toothing running substantially in axial direction, and thus a rotation of the rotatable ring is prevented in one direction. The rotatable ring can be turned in the other direction, usually counterclockwise (arrow 32, FIG. 2). In so doing the flexible tongues 26 are each pressed downward by means of the advancing inclined flanks of the toothing 25. They then engage at the next tooth base.

At least one flexible tongue is necessary just to achieve the effect that the rotatable ring 4 can only be rotated in one direction. The flexible tongues 26 have in addition the function of pressing the rotatable ring upward in axial direction so that projections 11.1, 11.2, 11.3 are contiguous to the upper groove surface 8 and thus facilitate a rotation of the rotatable ring 4 substantially without axial play. Of course the angular position of the plurality of flexible tongues 26 and the regular distribution of the toothing 25 are coordinated with one another in such a way that in each lock-in position all flexible tongues 26 are contiguous to an axially directed tooth flank.

Figure 3A:
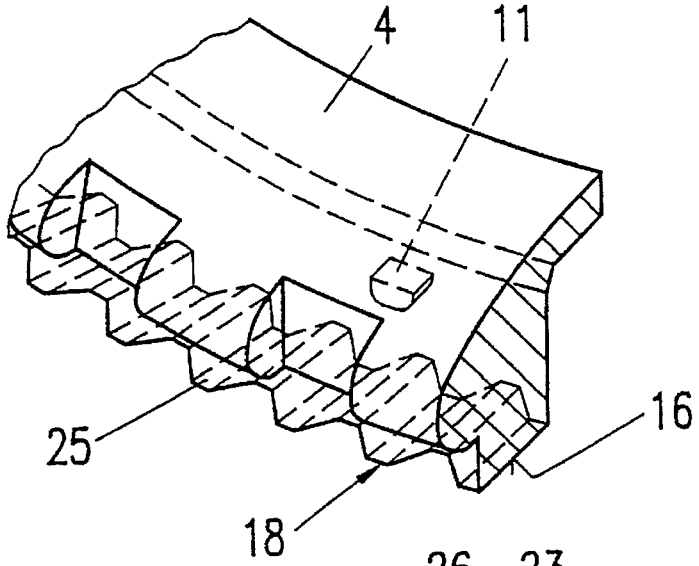
FIGS. 3A–3C show a perspective view, which has been dissected, of a part of a wristwatch according to FIG. 1, FIG. 3A showing a sector of the rotatable ring, FIG. 3B a sector of a spring, and FIG. 3C a sector of the case.
Figure 3B:
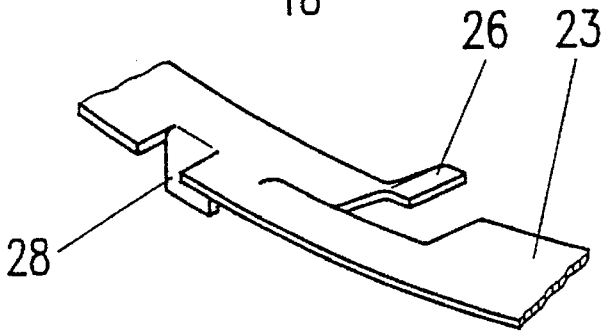
Figure 3C:
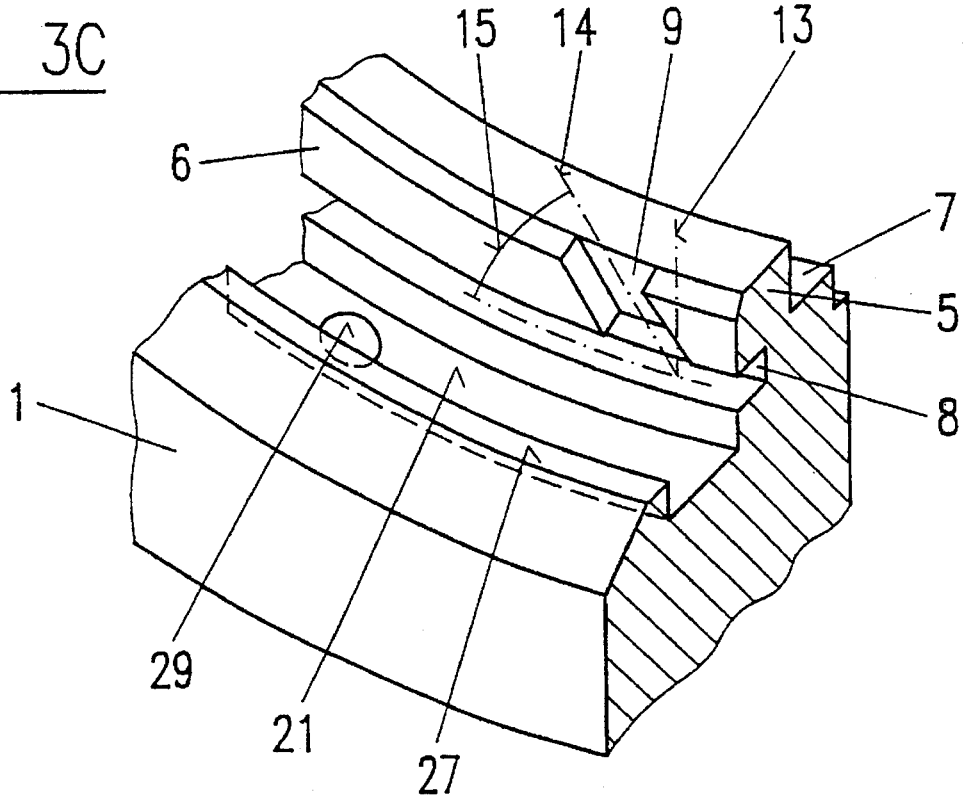

By means of a blocking tab (28), which according to FIG. 3B is bent down in the axial direction from the leaf spring 23, and a bore 29, which according to FIG. 3C is put in the watchcase 1 on the face 21 of the further groove, a turning of the leaf spring 23 about the longitudinal axis of the watch is prevented.

So that the rotatable ring can be easily adjusted, knurls 33 can be provided on one of its outwardly directed sides.

Other embodiments, both of the toothing 25 and of the spring-impinged elements, are conceivable. The toothing could, for example, be trapezoidal or rounded and of the type where a rotation of the rotatable ring is possible in both directions of rotation. There are many conceivable variant embodiments possible. The leaf spring 23 does not necessarily have to be annular; several separate segments could be foreseen instead.

For each segment it would then have to be foreseen that a predetermined angular position is maintained with respect to the longitudinal axis of the watch. This could be achieved using means other than the blocking tab 28 and bore 29, which have been shown only as examples. Likewise conceivable is that groove 8 is not continously encircling; provided instead would be groove segments, separate from each other. Only one notch 9 would then lead into each groove segment, and for each groove segment one peg-shaped projection 11 would be foreseen on the rotatable ring 4.

Figure 4A:
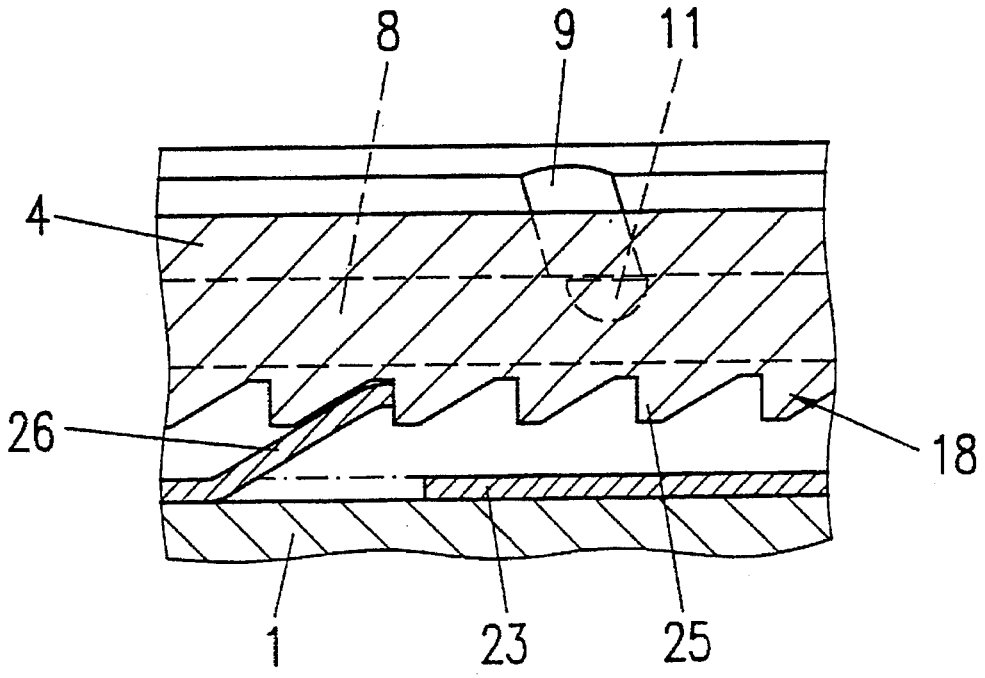
FIGS. 4A, 4B are illustrations to explain the functioning of the rotatable ring fastened according to the invention, FIG. 4A showing in particular the situation during removal of the rotatable ring.
Figure 4B:
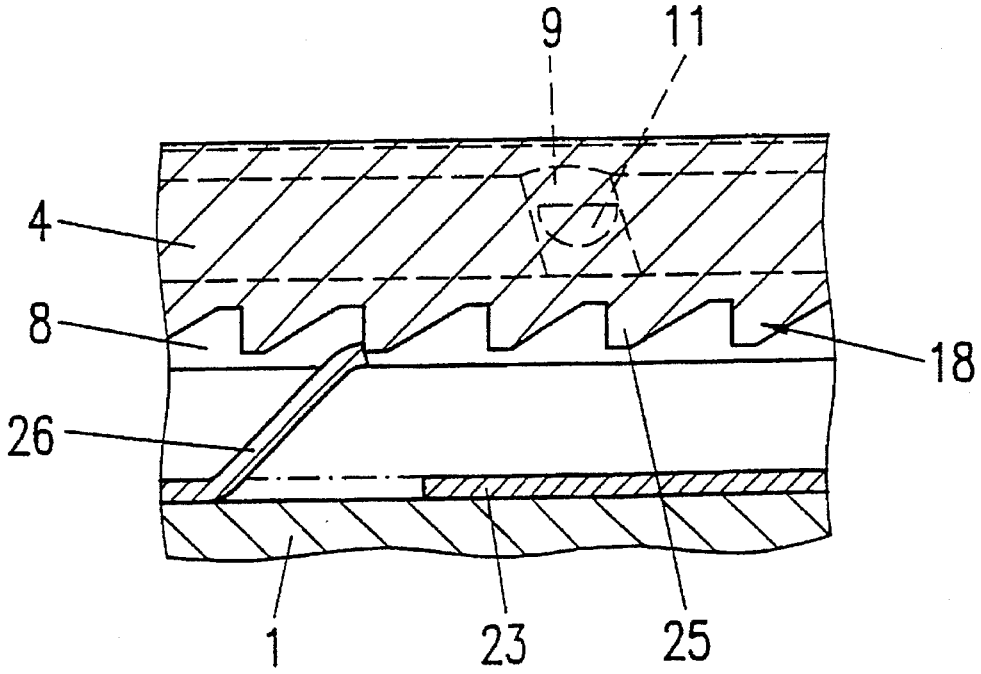

Shown in FIGS. 4A and 4B is how the rotatable ring can be removed in a device according to the previously described example. From FIG. 4A it can be seen that the lock-in position of the toothing 25 of the first engagement means 18, the flexible tongues 26 of the leaf spring 23, the notches 9 in the watchcase 1 and the peg-shaped projections 11 of the rotatable ring 4, which slide along the groove 8 in the watchcase 1, are to be coordinated with one another. This should be done preferably in such a way that the projections, when they are located in the area of the notches associated with them, overlap minimally in the rotational direction the notch openings extending into the groove 8. If, using a certain amount of force, the rotatable ring 4 is turned in the opposite direction, the flexible tongues 26 are bent slightly up, as shown in FIG. 4B, and the projections 11 slip from the notches 9 upward. There is a mutual play between tooth flanks, flexible tongues, projections and notches, these parts being harmonized with one other in such a way that using a certain amount of force, a backwards turning of the rotatable ring 4 is possible to the point where the projections 11 are located in groove 8 directly below the notch openings. By means of the resilience of the flexible tongues, the projections 11 are then already pressed just a little into the notches 9. By means of an increased backwards turning, the projections 11 can then slide out of the notches 9. It can then occur that the flexible tongues 26 are bent up and partially broken off. However, unlike a watchcase 1 or a rotatable ring 4, a leaf spring 23 can be replaced easily and cheaply.

Figure 5:
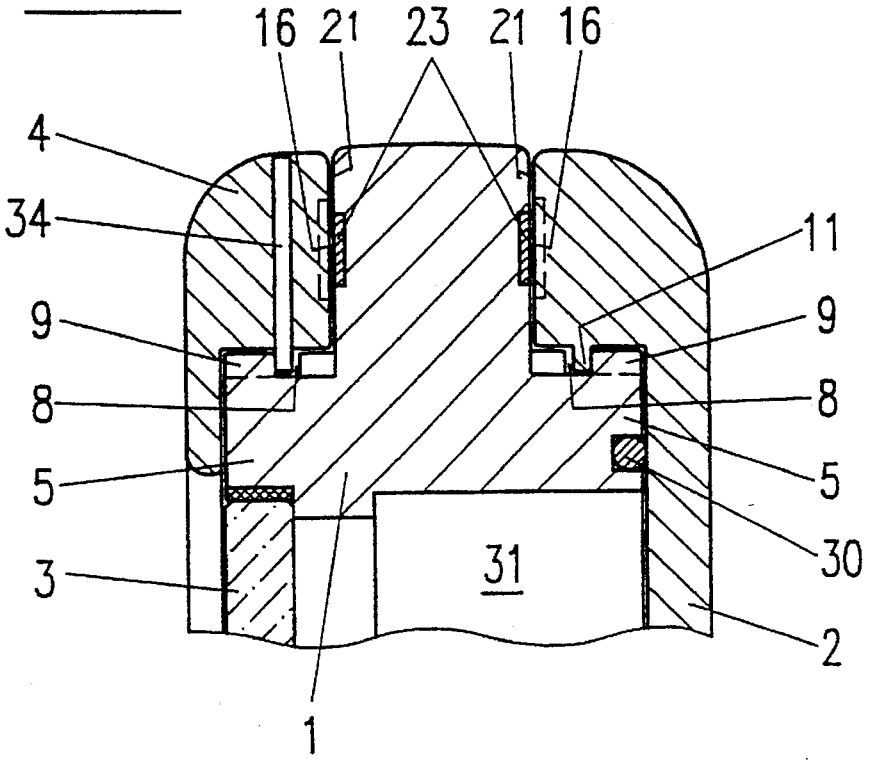
FIG. 5 is a second example embodiment of a wristwatch, in which both the rotatable ring and the back cover are fastened with the device according to the invention.

Shown in FIG. 5 is a second example embodiment of a watch in which the rotatable ring 4 is fastened essentially as previously described. While in the foregoing the peg-shaped projections 11 in the rotatable ring 4 have been designed as, for example, punched projections, here they are pins 34, which are inserted through radially directed bores in the rotatable ring 4. These projections function the same way, however. Moreover, it is shown in the second example embodiment that essentially not only can a rotatable ring 4 can be fastened to the watchcase with the device according to the invention, but this device can just as well be used to fasten the back cover 2. For this purpose the watchcase has in addition a shoulder 5 turned downward, toward the back cover 2. This shoulder is of essentially the same design as the previously described shoulder 5 turned toward the watch-glass 3. Disposed on the back cover 2 are also peg-shaped projections 11, which can be inserted through notches 9 into a further encircling groove 8 on the further shoulder 5. A sealing element 30 is disposed between the back cover 2 and the watchcase 1 in such a way that no water and also no dirt can get into the internals of the case. Sealing elements of this kind are known, and do not need to be further described here.

Figure 6:
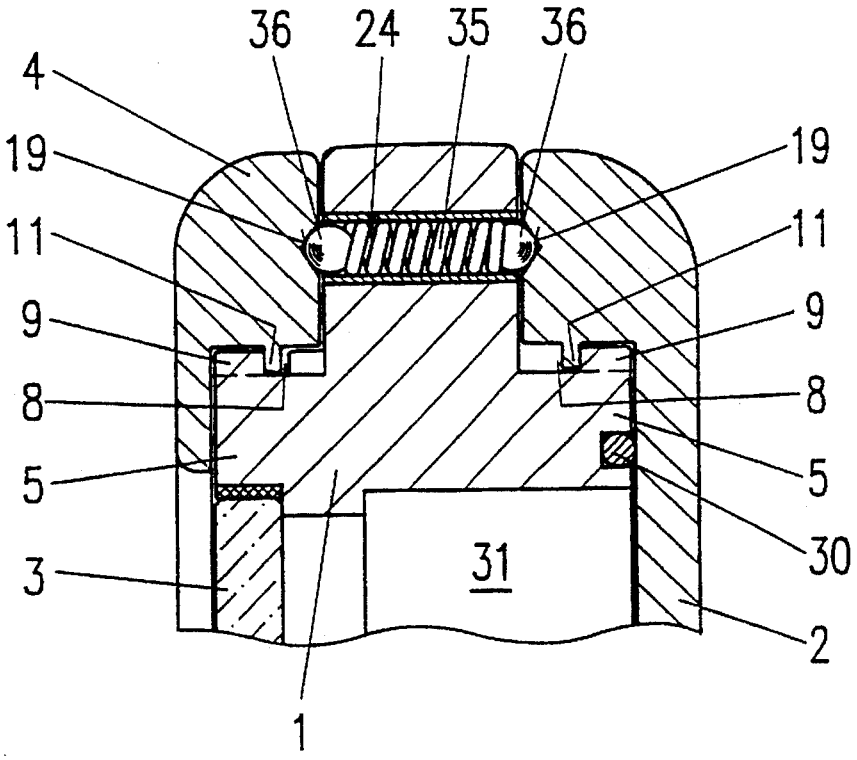
FIG. 6 is a third example embodiment of a wristwatch, in which the rotatable ring and the back cover are fastened as in the embodiment shown in FIG. 5, but using another type of engagement means, however.

Unlike the embodiment example of FIG. 5, the third example embodiment in FIG. 6 is one having merely different engagement means. Instead of the aforementioned leaf spring with the bent up flexible tongues and the toothing, here one or more axially directed bores are provided in the case 1 of the watch. In these bores the second engagement means 24 engage. These means comprise in each case a pressure spring 35 and on both sides of the bore one ball 36 each, protruding partially out of the bore. The bore is closed at its ends in such a way that the balls 36 cannot fall out. Designs of this type are known. The balls 36 can be pressed together in axial direction. Second engagement means are provided on the faces adjacent to the faces of the watchcase 1 out of which the balls 36 project as well as on the faces of the rotatable ring 4 and also of the back cover 2. These means comprise at least one depression 19 for each of the balls 36. After insertion of the projections 11 into the encircling groove 8 for the rotatable ring 4 and the projections 11 in the likewise encircling groove 8 for the back cover 2, these two parts can be rotated about the longitudinal axis of the watch until the balls 36 engage into a depression 19. Further rotation of the corresponding part is then impeded, or made almost impossible, depending upon the resilience of the pressure spring 35 or the design of the depression 19. It can be foreseen that several depressions 19 are distributed over a periphery in a particular regular distribution.

In the embodiment according to FIG. 6, it would be possible, of course, to screw the back cover according to the embodiment of FIGS. 1 to 3C together with the watchcase 1 and attach only the rotatable ring 4 using the inventive device. The bore in which the pressure spring 35 is disposed would in that case not be continuous, but open on one end only. Instead of the rotatable ring 4, a watch could be foreseen having only a back cover attached according to the invention.

Figure 7:
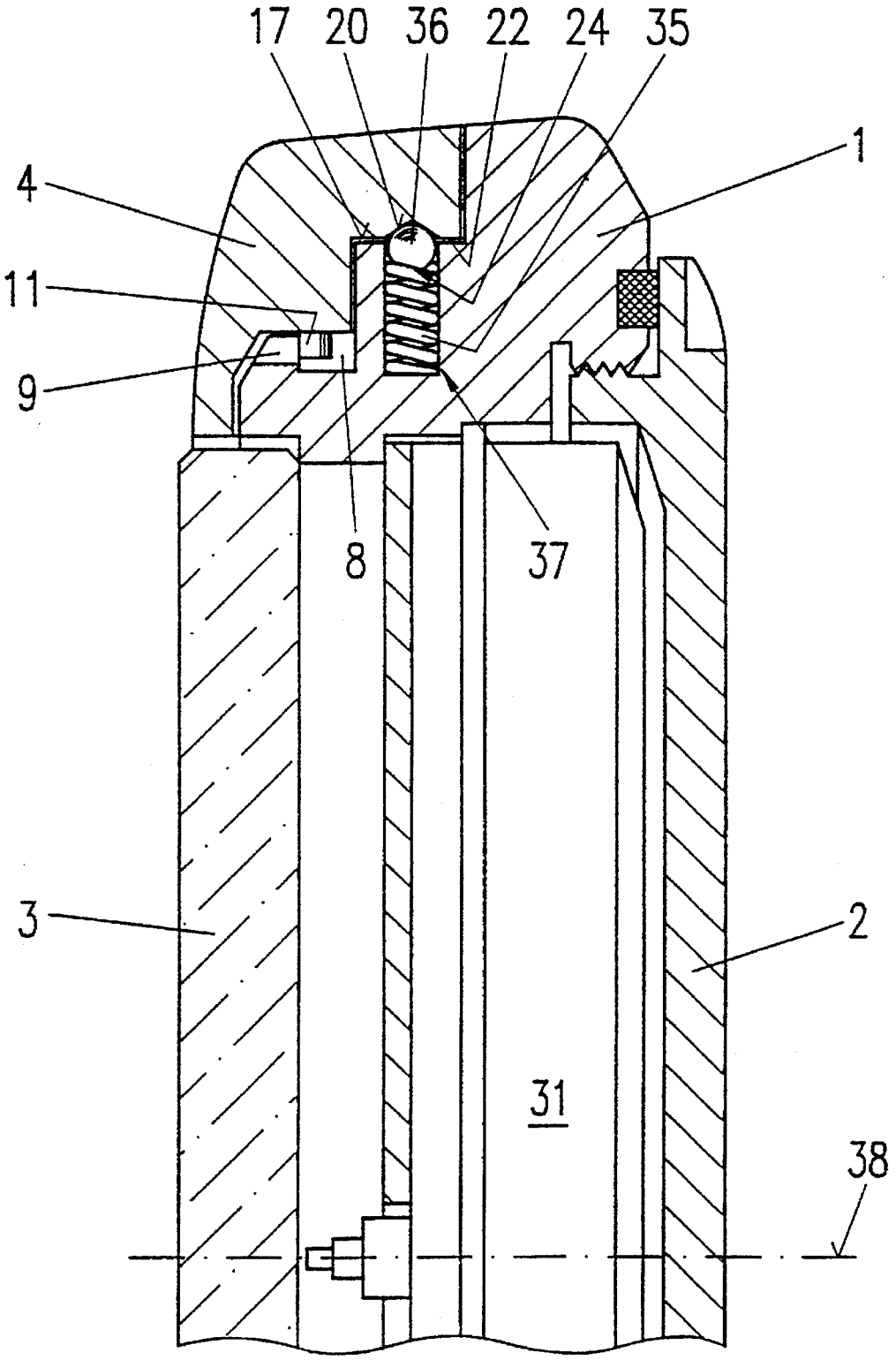
FIG. 7 is a cross-section through a wristwatch, essentially according to FIG. 1, the engagement means being designed differently from the first example embodiment.

FIG. 7 shows a fourth example embodiment of a wristwatch. As in the embodiment example first described, the back cover 2 is screwed together with the watchcase, the rotatable ring being fastened according to the invention. The second engagement means 24 and the first engagement means 20 comprise a ball 36 impinged by a spring 35, the ball engaging in a depression 20, as has been described in the foregoing. Shown, using this example embodiment, is that the engagement means 20, 24 can also work on generated surfaces 17, 22 turned toward each other, here those of the rotatable ring 4, which is the part to be fastened, and of the watchcase 1.

Anyone skilled in the art can conceive, without any inventive step, that the watch-glass 3 can be fastened using the device according to the invention, even though this is not shown in any of the figures.

It is likewise possible to form the groove and the notches on the part to be fastened, for example on the rotatable ring or on the back cover, and to dispose the peg-shaped projections on the watchcase. Embodiments, in which, for example, the groove and the notches for fastening the rotatable ring are disposed on the watchcase while to fasten the back cover the groove and the notches are disposed on the back cover, or vice-versa, are likewise conceivable. The grooves and the notches could also be provided on the inner generated surface of the shoulder formed on the case and could cooperate with peg-shaped projections directed radially outward of the part to be fastened. The projections and the groove with the notches could also be interchanged with respect to the inner generated surface mentioned here. The invention thus extends to interchanged placement of elements of the fastening device according to the invention if the same effect is thereby achieved.

What is claimed is:

1. A device for fastening a rotationally symmetrical part, to a watchcase, the watchcase comprising:

at least one encircling, rotationally symmetrical shoulder protruding in axial direction with respect to the watchcase, the shoulder having an inner and an outer generated surface, an encircling groove, running along the said outer or inner generated surface, for each part to be fastened on the watchcase, at least two notches, which are distributed over the groove circumference and which extend in essentially axial direction to the face of the shoulder which protrudes away from the watchcase, and essentially peg-shaped projections on the part to be fastened, the number of projections corresponding to the number of notches, and the projections being insertable through the notches into the groove and turnable along the groove at least in a limited area.

2. The device of claim 1, wherein the rotationally symmetrical part is a rotatable ring or a back cover or a watch-glass.

3. The device of claim 1, wherein the notches of the shoulder and the projections of the part to be fastened are distributed irregularly over the circumference of the shoulder, respectively of the part, and contain a plurality of angles, unequal to each other, whereby the angles contained between each two adjacent notches and projections are equal.

4. The device of claim 1, wherein the notches extend in axial direction at a right angle to the associated groove.

5. The device of claim 1, wherein the notches extend diagonally to the associated groove, the smaller angle contained between each one of the notches and the groove being preferably 45°.

6. The device of claim 1, wherein disposed on one of the surfaces of the part to be fastened turned toward the watchcase are first engagement means and provided on one of the surfaces of the watchcase turned toward the part to be fastened are second engagement means, a continuing rotational movement being impeded or prevented by means of the two engagement means after mutual engagement following a certain turning movement of the part relative to the watchcase, while during the movement the projections slide into the groove.

7. The device of claim 6, wherein the said surfaces are in each case front surfaces or generated surfaces.

8. The device of claim 6, wherein the first engagement means comprise a toothing and the second engagement means at least one spring-impinged element engaging with the toothing.

9. The device of claim 8, wherein the spring-impinged element is a flexible tongue of an annular leaf spring, the flexible tongue and the toothing being directed against each other in such a way that the part fastened to the watchcase is rotatable in only one direction.

10. The device of claim 9, wherein the leaf spring is insertable in an annular depression on a face of the watchcase, a blocking tab of the leaf spring engaging in a bore of the watchcase preventing a turning of the leaf spring relative to the watch-case, and wherein provided in the area of each notch of the groove is a flexible tongue, which, with respect to the groove, is directed in a diagonal direction opposed to the course of the notch.

11. The device of claim 1, wherein provided between the watchcase and the part to be fastened thereon is a sealing element, which seals the case interior.

12. The device of claim 1, wherein the encircling groove is interrupted at least twice, at least two partially encircling partial grooves being created and wherein one notch per partial groove is provided.

13. The device of claim 1, wherein, with respect to their placement on the watchcase and on the part to be fastened thereto, the shoulder, the grooves with the notches, and the projections are interchanged.

* * * * *